US007274180B2

(12) United States Patent
Itoh

(10) Patent No.: US 7,274,180 B2
(45) Date of Patent: Sep. 25, 2007

(54) CONSTANT VOLTAGE OUTPUTTING METHOD AND APPARATUS CAPABLE OF CHANGING OUTPUT VOLTAGE RISE TIME

(75) Inventor: Kohzoh Itoh, Hyogo-ken (JP)

(73) Assignee: Ricoh Company, Ltd., Tokyo (JP)

( * ) Notice: Subject to any disclaimer, the term of this patent is extended or adjusted under 35 U.S.C. 154(b) by 340 days.

(21) Appl. No.: 11/055,493

(22) Filed: Feb. 10, 2005

(65) Prior Publication Data

US 2005/0189932 A1 Sep. 1, 2005

(30) Foreign Application Priority Data

Feb. 26, 2004 (JP) ..... 2004-051636

(51) Int. Cl.
*G05F 1/00* (2006.01)

(52) U.S. Cl. ..... 323/283; 323/268; 323/282; 323/284; 323/274

(58) Field of Classification Search ..... 323/268, 323/276, 277, 908, 274
See application file for complete search history.

(56) References Cited

U.S. PATENT DOCUMENTS 4,593,338 A * 6/1986 Takeda et al. ..... 361/18
5,570,004 A * 10/1996 Shibata ..... 323/303
6,031,364 A * 2/2000 Hosono et al. ..... 323/280
6,281,667 B1 * 8/2001 Matsumura ..... 323/274
6,801,419 B2 * 10/2004 Fukui ..... 361/93.1
7,002,329 B2 * 2/2006 Agari et al. ..... 323/284
2003/0137854 A1 7/2003 Nakajima

* cited by examiner

*Primary Examiner*—Patrick Assouad
*Assistant Examiner*—Emily P Pham
(74) *Attorney, Agent, or Firm*—Cooper & Dunham

(57) ABSTRACT

A constant voltage outputting apparatus includes an input terminal, an output terminal, a control unit, a plurality of output control transistors, and a switching unit. The input terminal receives an input voltage, and the output terminal outputs an output voltage. The control unit detects the output voltage and outputs a control signal equalizing the detected output voltage with a predetermined constant voltage. Each of the plurality of output control transistors receives the control signal and controls, according to the control signal, currents flowing from the input terminal to the output terminal. The switching unit switches the plurality of output control transistors to input the control signal thereto according to a predetermined setting. A constant voltage outputting method is also described.

26 Claims, 4 Drawing Sheets

CONSTANT VOLTAGE OUTPUTTING METHOD AND APPARATUS CAPABLE OF CHANGING OUTPUT VOLTAGE RISE TIME

BACKGROUND

1. Field

This patent specification relates to a constant voltage outputting method and apparatus capable of changing a rise time of an output voltage.

2. Discussion of the Background

In recent years, functions of a mobile device such as a mobile phone and a digital camera have become diverse, and performances and specifications of a power supply have also become diverse to keep up with the diverse functions of the mobile device. As a result, one mobile device needs to include a plurality of power supplies of different output voltages and different current capacities. Further, to prolong a running time of the mobile device, such control as to extend a battery life is performed by placing a circuit not used in a stand-by state or by turning the power supply off. Therefore, a plurality of power supply circuits are frequently activated and stopped within the mobile device.

Furthermore, a stabilized direct-current power supply device for performing a soft-start operation even when a reference voltage has risen is disclosed in Japanese Laid-Open Patent Publication No. 2003-216251. In this case, wherein a plurality of power supply circuits start operating at one time, if an output voltage rise time is substantially different among the plurality of power supply circuits, there arise such problems as a flow of an unintentionally large reactive current through the circuits and latch-up phenomenon occurring in the circuits. Therefore, the rise time of each of the plurality of power supply circuits should be determined so as to fall within a predetermined time period.

In FIG. 1, a typical background constant voltage circuit 100 includes an input terminal IN, an output terminal OUT, a reference voltage generation circuit 101, an error amplifier circuit AMPa, two resistors Ra and Rb, an output control transistor Ma, and an overcurrent protection circuit 102. The reference voltage generation circuit 101 generates and outputs a predetermined reference voltage Vref. The two resistors Ra and Rb detect an output voltage Vout. The constant voltage circuit 100 is connected to a load 110 via a bypass capacitor Ca.

A rise time of the output voltage Vout output from the constant voltage circuit 100 is determined mainly by combinations of current drive capacity of the output control transistor Ma, a value of a limited current of the overcurrent protection circuit 102, an amount of a phase compensation of the error amplifier circuit AMPa, a value of a load current flowing through the load 110, and capacitance of the bypass capacitor Ca.

Such factors as the value of the load current and the capacitance of the bypass capacitor Ca are different among circuits. Therefore, to set the rise time of the output voltage Vout output from the constant voltage circuit 100 within a predetermined time period, the value of the limited current of the overcurrent protection circuit 102 is adjusted by such techniques as a laser trimming in accordance with the value of the load current, the capacitance of the bypass capacitor, and so forth.

According to this background method of setting the output voltage rise time by using the laser trimming technique, however, circuit parameters of a constant voltage circuit are fixed, and thus versatility of the constant voltage circuit is diminished. As a result, in a circuit in which a different amount of the load current flows at every rise of a power supply circuit, even when the laser trimming is performed under a predetermined condition, if a condition under which the power supply circuit rises is changed, there arises a difference between an output voltage rise time of the power supply circuit and an output voltage rise time of another power supply circuit.

SUMMARY

This patent specification describes a novel constant voltage outputting apparatus. In one example, a novel constant voltage outputting apparatus includes an input terminal, an output terminal, a control unit., a plurality of output control transistors, and a switching unit. The input terminal is configured to receive an input voltage, and the output terminal is configured to output an output voltage. The control unit is configured to detect the output voltage and output a control signal equalizing the detected output voltage with a predetermined constant voltage. Each of the plurality of output control transistors is configured to receive the control signal and control, according to the control signal, currents flowing from the input terminal to the output terminal. The switching unit is configured to switch the plurality of output control transistors to input the control signal thereto according to a predetermined setting.

The switching unit may be preset to select at least one of the plurality of output control transistors.

The switching unit may be preset to select at least one of the plurality of output control transistors at any necessary time after the output voltage has risen.

This patent specification further describes another constant voltage outputting apparatus. In one example, this constant voltage outputting apparatus includes an input terminal, an output terminal, a plurality of constant voltage circuits of different characteristics, and a switching unit. The input terminal is configured to receive an input voltage, and the output terminal is configured to output an output voltage. Each of the plurality of constant voltage circuits of different characteristics is configured to generate a predetermined constant voltage based on the input voltage and output the predetermined constant voltage to the output terminal. The switching unit is configured to switch the plurality of constant voltage circuits to activate one of the plurality of constant voltage circuits selected in advance and deactivate the rest of the plurality of constant voltage circuits.

Each of the plurality of constant voltage circuits may include an output voltage detection circuit, a reference voltage generation circuit, an error amplifier circuit, and an output control transistor. The output voltage detection circuit may be configured to detect the output voltage and output a proportional voltage which is proportional to the detected output voltage. The reference voltage generation circuit may be configured to generate and output a predetermined reference voltage. The error amplifier circuit may be configured to output a control signal equalizing the proportional voltage with the predetermined reference voltage. The output control transistor may be configured to receive the control signal and control, according to the control signal, currents flowing from the input terminal to the output terminal.

For the rest of the plurality of constant voltage circuits, the switching unit may stop operation of the error amplifier circuit and electric supply to the output voltage detection circuit and the reference voltage generation circuit.

The switching unit may be preset to select one of the plurality of constant voltage circuits at any necessary time after the output voltage has risen.

The switching unit may allow the control signal output from the error amplifier circuit of the activated one of the plurality of constant voltage circuits to be input in at least one of the output control transistors of the plurality of constant voltage circuits, which is selected in advance.

This patent specification further describes a novel constant voltage outputting method. In one example, a novel constant voltage outputting method includes providing an input terminal configured to receive an input voltage and an output terminal configured to output an output voltage, providing a plurality of output control transistors and a switching unit, detecting the output voltage, outputting a control signal equalizing the detected output voltage with a predetermined constant voltage, and switching the plurality of output control transistors to input the control signal thereto according to a predetermined setting to control, according to the control signal, currents flowing from the input terminal to the output terminal.

The switching unit may be preset to select at least one of the plurality of output control transistors.

The switching unit may be preset to select at least one of the plurality of output control transistors at any necessary time after the output voltage has risen.

This specification further describes another constant voltage outputting method. In one example, this constant voltage outputting method includes providing an input terminal configured to receive an input voltage and an output terminal configured to output an output voltage, providing a plurality of constant voltage circuits of different characteristics and a switching unit, switching the plurality of constant voltage circuits to generate a predetermined constant voltage based on the input voltage, activating one of the plurality of constant voltage circuits selected in advance, deactivating the rest of the plurality of the constant voltage circuits, and outputting the predetermined constant voltage to the output terminal.

The outputting step may include detecting the output voltage and outputting a proportional voltage which is proportional to the detected output voltage, generating and outputting a predetermined reference voltage, outputting a control signal equalizing the proportional voltage with the predetermined reference voltage, and controlling, according to the control signal, currents flowing from the input terminal to the output terminal.

The deactivating step may stop operation of the rest of the plurality of constant voltage circuits.

The switching unit may be preset to select one of the plurality of constant voltage circuits at any necessary time after the output voltage has risen.

The switching step may allow the control signal generated by the activated one of the plurality of constant voltage circuits to be input in at least one of the plurality of constant voltage circuits selected in advance.

BRIEF DESCRIPTION OF THE DRAWINGS

A more complete appreciation of the disclosure and many of the advantages thereof are readily obtained as the same becomes better understood by reference to the following detailed description when considered in connection with the accompanying drawings, wherein.

DETAILED DESCRIPTION OF PREFERRED EMBODIMENTS

Figure 1:
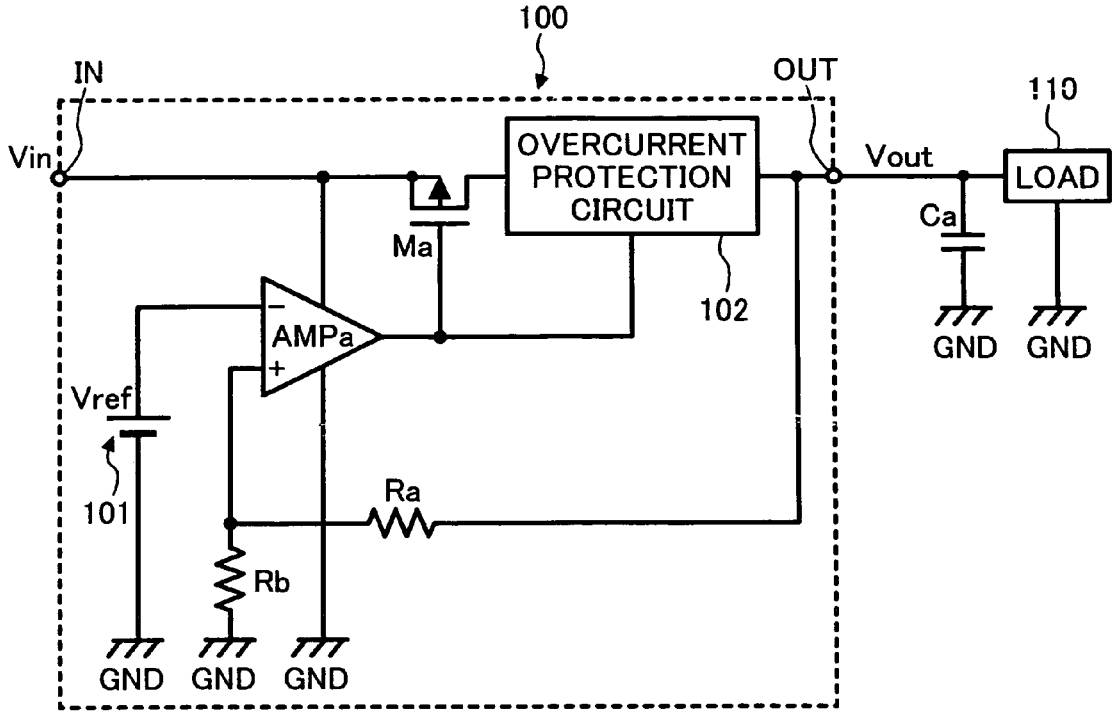
FIG. 1 PRIOR ART
FIG. 1 is a circuit diagram illustrating an exemplary configuration of a background constant voltage circuit.

In describing preferred embodiments illustrated in the drawings, specific terminology is employed for the purpose of clarity. However, the disclosure of this patent specification is not intended to be limited to the specific terminology so used and it is to be understood that substitutions for each specific element can include any technical equivalents that operate in a similar manner.

Figure 2:
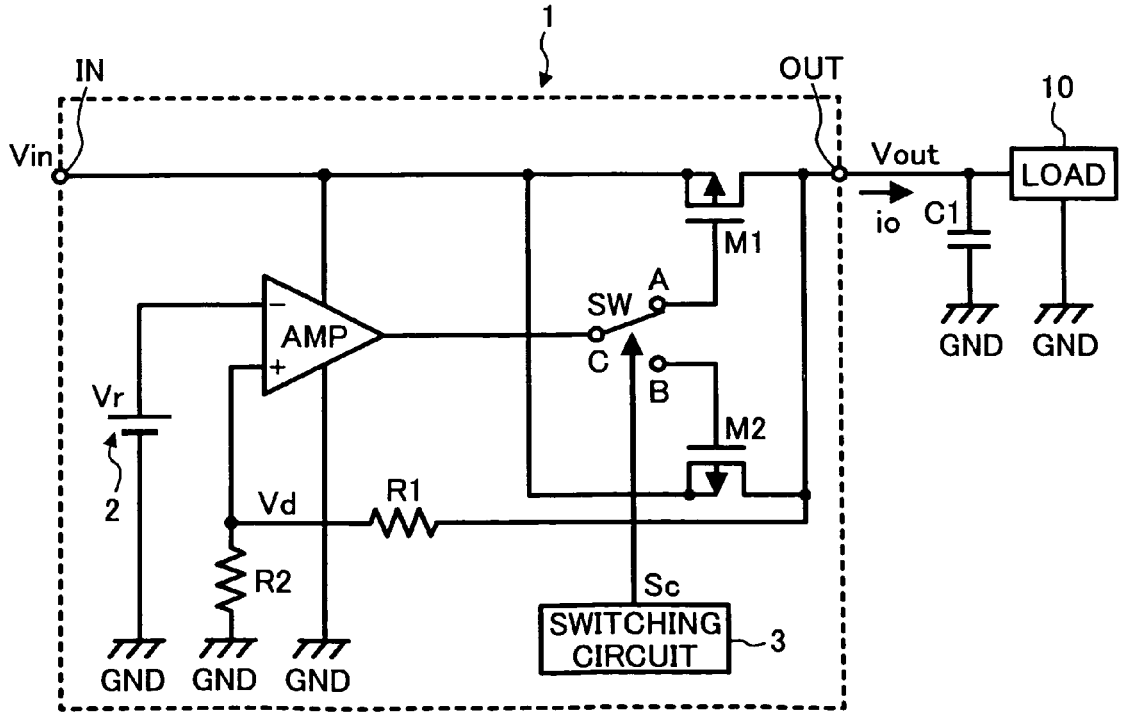
FIG. 2 is a circuit diagram illustrating an exemplary configuration of a constant voltage circuit according to an embodiment.

Referring now to the drawings, wherein like reference numerals designate identical or corresponding parts throughout the several views, FIG. 2 illustrates a configuration of a constant voltage circuit 1 according to an embodiment of this disclosure.

In FIG. 2, the constant voltage circuit 1 includes an input terminal IN, an output terminal OUT, a reference voltage generation circuit 2 for generating and outputting a predetermined reference voltage Vr, an error amplifier circuit AMP, two resistors R1 and R2 for detecting an output voltage Vout, output control transistors M1 and M2 each formed by a PMOS (P-channel metal oxide semiconductor) transistor, a switch SW, and a switching circuit 3 for causing the switch SW to perform a switching operation in a predetermined manner. The constant voltage circuit 1 is connected to a load 10, and a bypass capacitor C1 is connected between the output terminal OUT and the ground voltage terminal GND.

The constant voltage circuit 1 receives an input voltage Vin from the input terminal IN, generates a predetermined constant voltage V1, and outputs the predetermined constant voltage V1 as the output voltage Vout from the output terminal OUT to supply the output voltage Vout to the load 10. The reference voltage generation circuit 2, the error amplifier circuit AMP, and the resistors R1 and R2 form a control circuit unit, and the switch SW and the switching circuit 3 form a switching circuit unit.

The output control transistors M1 and M2 are connected in parallel between the input terminal IN and the output terminal OUT. A gate of the output control transistor M1 is connected to a terminal A of the switch SW, and a gate of the output control transistor M2 is connected to a terminal B of the switch SW. A common terminal C of the switch SW is connected to an output terminal of the error amplifier circuit AMP. In accordance with a switching control signal Sc output from the switching circuit 3, the switch SW connects the common terminal C to either one of the terminals A and B.

Further, the resistors R1 and R2 are connected in series between the output terminal OUT and the ground voltage terminal GND. A connection point between the resistors R1 and R2 is connected to a noninverting input terminal of the error amplifier circuit AMP, and the reference voltage Vr is input in an inverting input terminal of the error amplifier circuit AMP. Furthermore, the load 10 and the bypass capacitor C1 is connected in parallel between the output terminal OUT and the ground voltage terminal GND. The error amplifier circuit AMP is driven by the input voltage Vin and a ground voltage.

In the constant voltage circuit 1 thus configured, the switching circuit 3 is preset to select either one of the output control transistors M1 and M2 and output, upon power-on of a power supply, the switching control signal Sc to the switch SW according to the presetting. In accordance with the switching control signal Sc, the switch SW connects the output terminal of the error amplifier circuit AMP to the gate of either one of the output control transistors M1 and M2. In this example, a current drive capacity is different between the output control transistors M1 and M2. For example, a device size of the output control transistor M2 is smaller than a device size of the output control transistor M1, and thus a current drive capacity of the output control transistor M2 is smaller than a current drive capacity of the output control transistor M1.

A series circuit formed by the resistors R1 and R2 divides the output voltage Vout to generate and input a divided voltage Vd in the noninverting input terminal of the error amplifier circuit AMP. Then, the error amplifier circuit AMP controls operation of the output control transistor connected via the switch SW to the output terminal of the error amplifier circuit AMP so as to equalize the divided voltage Vd with the reference voltage Vr. Specifically, the error amplifier circuit AMP sends a control signal to the output control transistor so that the output control transistor controls currents flowing from the input terminal IN to the output terminal OUT in accordance with the control signal.

Figure 3:
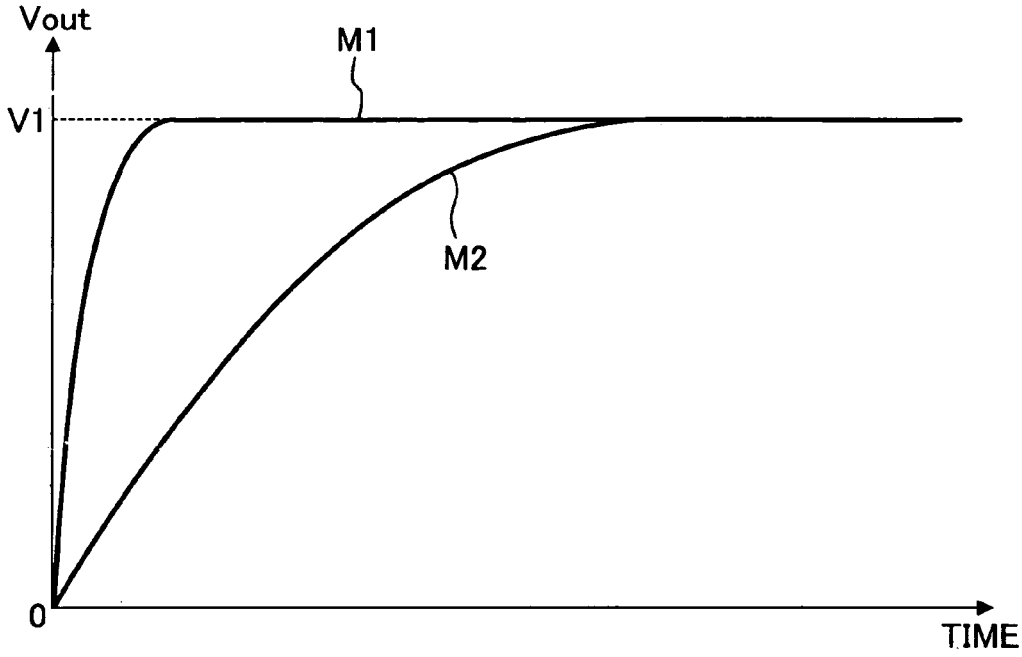
FIG. 3 is a graph illustrating a relationship between an output voltage Vout and a time taken for raising the output voltage Vout by using an output control transistor and a relationship between an output voltage Vout and a time taken for raising the output voltage Vout by using another output control transistor.

When the output control transistor M2 is used to raise the output voltage Vout upon the power-on of the power supply, a longer time is taken for raising the output voltage Vout than in a case where the output control transistor M1 is used, as observed from a graph of FIG. 3. That is, when the output control transistor M2 is used, an amount of an output current io is restricted by a limited drain current value of the output control transistor M2 until the output voltage Vout reaches the predetermined constant voltage V1. Therefore, charging of the bypass capacitor C1 takes time, and thus the output voltage Vout increases relatively linearly and gradually, as observed from FIG. 3.

As described above, consideration is made to a state of the load 10 when the power supply is powered on, and a rise time of an output voltage output from another power supply circuit which is powered on at the same time as the power supply is powered on. Also, the switching circuit 3 is preset to select either one of the output control transistors M1 and M2 so that a rise time of the output voltage Vout output from the constant voltage circuit 1 approximates the rise time of the output voltage output from the another power supply circuit. By so doing, an appropriate output voltage Vout rise characteristic can be obtained. Further, setting of the switching circuit 3 may be changed at any necessary time after the output voltage Vout has risen such that the switching circuit 3 switches to either one of the output control transistors M1 and M2, which is more suitable in consideration of such factors as an amount of the load current and performance requested for the power supply by the load.

Figure 4:
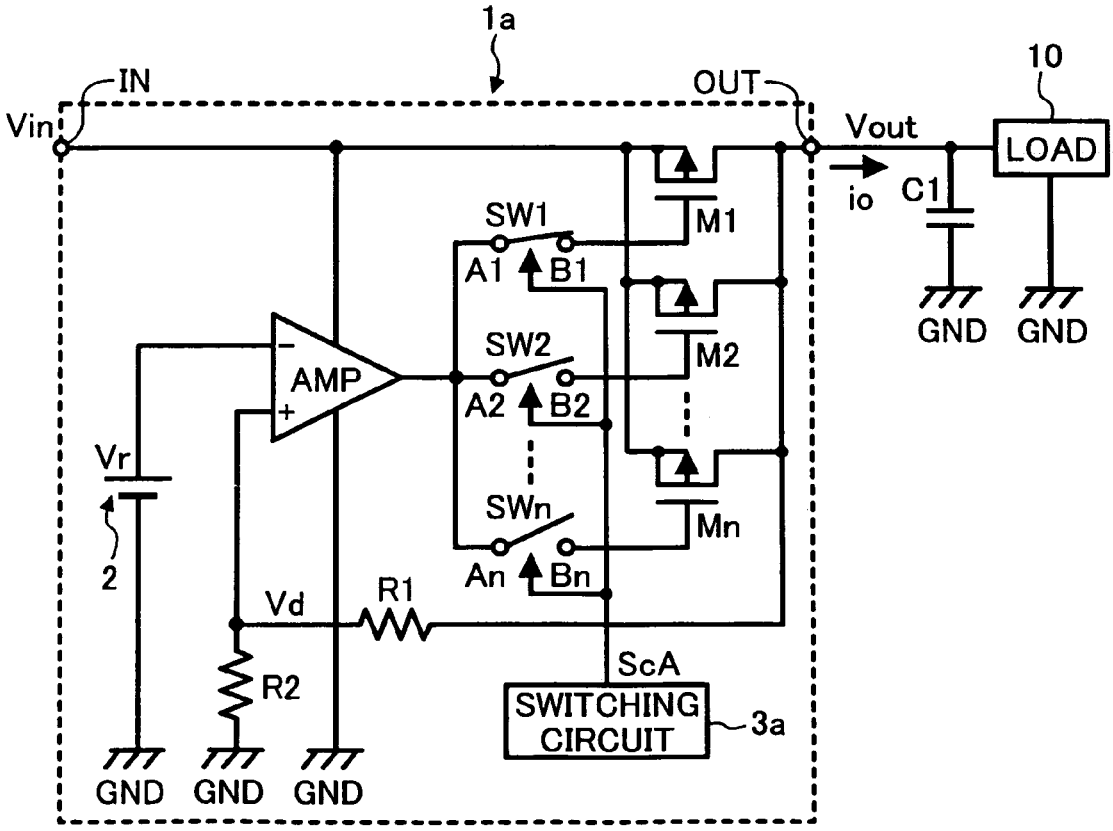
FIG. 4 is a circuit diagram illustrating an exemplary configuration of a constant voltage circuit according to another embodiment.

The embodiment described above with reference to FIG. 2, in which two output control transistors are used, is one of many possible examples. Therefore, as illustrated in FIG. 4, it is also possible to form the constant voltage circuit with more than two output control transistors of different current drive capacities, in which any one of the more than two output control transistors is selected for use. A constant voltage circuit 1*a* of FIG. 4 is described below, wherein description is omitted for components of the constant voltage circuit 1*a* which are also components of the constant voltage circuit 1 shown in FIG. 2, and differences between the constant voltage circuit 1 of FIG. 2 and the constant voltage circuit 1*a* of FIG. 4 are described.

In FIG. 4, the constant voltage circuit 1*a* includes the input terminal IN, the output terminal OUT, the reference voltage generation circuit 2, the error amplifier circuit AMP, the two resistors R1 and R2, a plurality of output control transistors M1 to Mn (n is a positive integer) each formed by a PMOS transistor, a plurality of switches SW1 to SWn, and a switching circuit 3*a* for performing a switching control of the switches SW1 to SWn in a predetermined manner. The constant voltage circuit 1*a* is connected to a load 10. The bypass capacitor C1 is connected between the output terminal OUT and the ground voltage terminal GND. The switches SW1 to SWn and the switching circuit 3*a* form the switching circuit unit.

The constant voltage circuit 1*a* of FIG. 4 is different from the constant voltage circuit 1 of FIG. 2 in that the output control transistors M1 and M2 of FIG. 2 are replaced by the plurality of output control transistors M1 to Mn, the switch SW of FIG. 2 is replaced by the plurality of switches SW1 to SWn, and the switching circuit 3 of FIG. 2 is replaced by the switching circuit 3*a*. The switches SW1 to SWn are provided respectively for the corresponding output control transistors M1 to Mn. The switching circuit 3*a* is designed to turn on one of the switches SW1 to SWn which is set in advance.

The output control transistors M1 to Mn are connected in parallel between the input terminal IN and the output terminal OUT. A gate of each of the output control transistors M1 to Mn is connected to a corresponding one of terminals B1 to Bn of corresponding switches SW1 to SWn. Terminals A1 to An of the switches SW1 to SWn are connected to an output terminal of the error amplifier circuit AMP. In accordance with a switching control signal ScA output from the switching circuit 3*a*, each of the switches SW1 to SWn individually performs a switching operation, and one of the switches SW1 to SWn selected in accordance with the switching control signal ScA is turned on to electrically communicate with a corresponding one of the output control transistors M1 to Mn.

In the constant voltage circuit 1*a* of FIG. 4 thus configured, all of the output control transistors M1 to Mn may have an equal current drive capacity. Alternatively, all or some of the output control transistors M1 to Mn may have different current drive capacities.

When each of the output control transistors M1 to Mn has a different current drive capacity, and if a current drive capacity of the output control transistor M1 is defined as a value 1 and the current drive capacity of each of the output control transistors M1 to Mn is set to be a value $2^{n-1}$, the current drive capacities of the output control transistors M1 to Mn can be set within a range of $1+2+2^2+\ldots+2^{n-1}$. For example, the current drive capacity of the output control transistor M2 is $2^{2-1}=2$.

Furthermore, the current drive capacity of each of the output control transistors M1 to Mn may be set in accordance with conditions required for powering the load 10. Further, a plurality of output control transistors may be simultaneously operated so as to satisfy the conditions required for powering the load 10. Setting of the switching circuit 3*a* may be changed at any necessary time after the output voltage Vout has risen such that the switching circuit 3*a* switches to any one of the output control transistors M1 to Mn, which is the most suitable in consideration of such factors as an amount of the load current and performance requested for the power supply by the load 10.

In the constant voltage circuits according to the above embodiments, when the power supply is powered on, at least one of the plurality of output control transistors is selected to change the current drive capacity and thus change the rise time of the output voltage Vout. Accordingly, it is possible to approximate the rise time of the output voltage Vout to the rise time of the power supply in accordance with the conditions required for powering the load 10.

Figure 5:
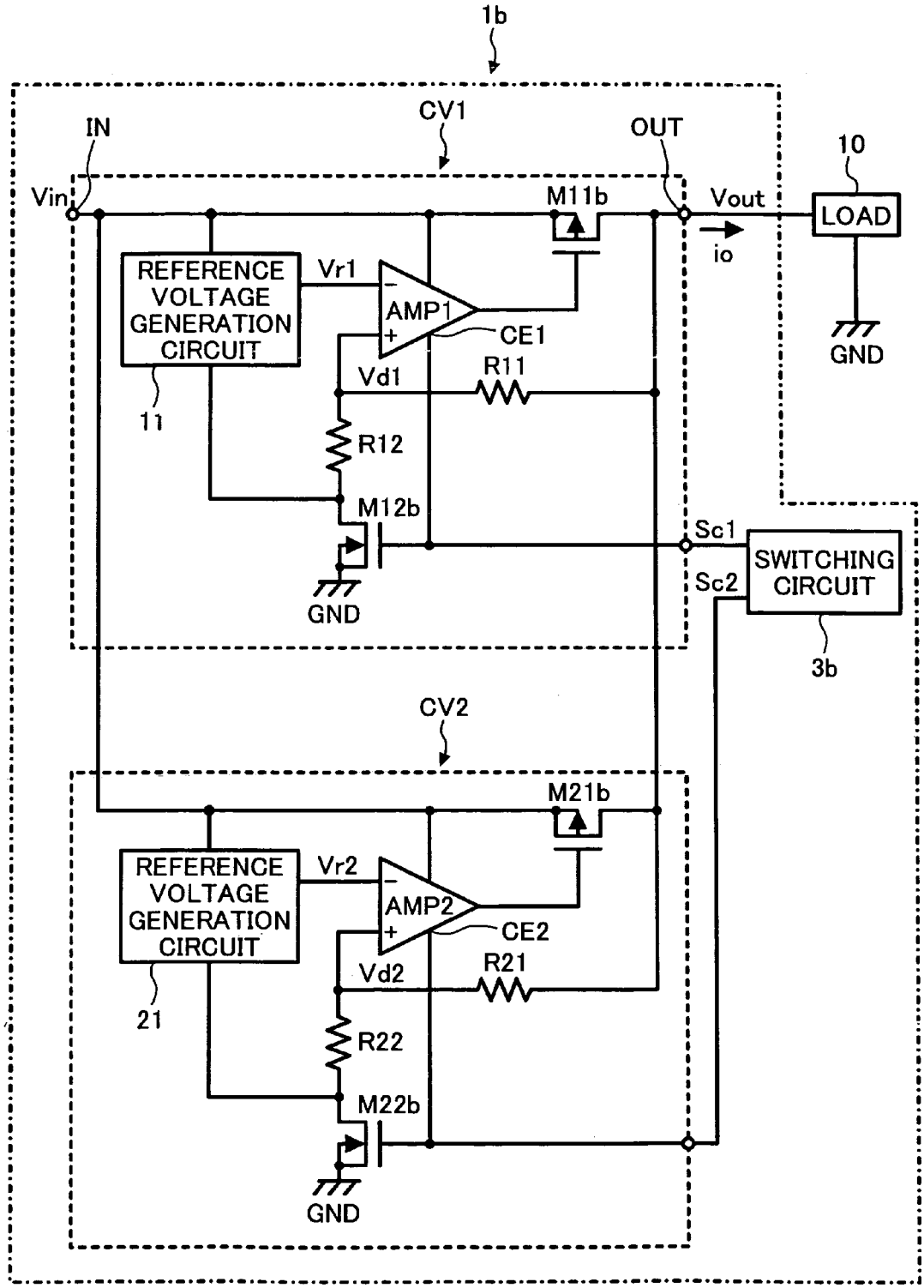
FIG. 5 is a circuit diagram illustrating an exemplary configuration of a constant voltage circuit according to still another embodiment.

In the above embodiments, a plurality of output control transistors are included in one constant voltage circuit so that at least one of the output control transistors is selected for use in accordance with the conditions required for powering the load 10. As illustrated in FIG. 5, there is another embodiment which includes a plurality of constant voltage circuits of different characteristics so that one of the constant voltage circuits is selected for use in accordance with the conditions required for powering the load 10. In this case, the different characteristics include, for example, different consumption currents, maximum output currents, ripple rejection frequencies, and transient responses.

A constant voltage circuit 1*b* of FIG. 5 includes a first constant voltage circuit CV1, a second constant voltage circuit CV2, and a switching circuit 3*b*. The constant voltage circuit 1*b* is connected to the load 10. The first constant voltage circuit CV1 has relatively high responsiveness to a change in each of the input voltage Vin and the output voltage Vout. Meanwhile, the second constant voltage circuit CV2 has a substantially small amount of self-consumption current. The switching circuit 3*b* selects to activate either one of the first constant voltage circuit CV1 and the second constant voltage circuit CV2 according to a setting made in advance.

The first constant voltage circuit CV1 includes the input terminal IN, the output terminal OUT, a reference voltage generation circuit 11 for generating and outputting a predetermined reference voltage Vr1, an error amplifier circuit AMP1, two resistors R11 and R12 for detecting the output voltage Vout, an output control transistor M11*b* formed by a PMOS transistor, and an NMOS transistor M12*b*. The reference voltage generation circuit 11 forms a reference voltage generation circuit unit. The error amplifier circuit AMP1 forms an error amplifier circuit unit. The resistors R11 and R12 form an output voltage detection circuit unit.

Similarly, the second constant voltage circuit CV2 includes a reference voltage generation circuit 21 for generating and outputting a predetermined reference voltage Vr2, an error amplifier circuit AMP2, two resistors R21 and R22 for detecting the output voltage Vout, an output control transistor M21*b* formed by a PMOS transistor, and an NMOS transistor M22*b*. The reference voltage generation circuit 21 forms a reference voltage generation circuit unit. The error amplifier circuit AMP2 forms an error amplifier circuit unit. The resistors R21 and R22 form an output voltage detection circuit unit.

In the first constant voltage circuit CV1, the output control transistor M11*b* is connected between the input terminal IN and the output terminal OUT. A gate of the output control transistor M11*b* is connected to an output terminal of the error amplifier circuit AMP1. Further, the resistors R11 and R12 and the NMOS transistor M12*b* are connected in series between the output terminal OUT and the ground voltage terminal GND. Each of a gate of the NMOS transistor M12*b* and a chip enable signal input terminal CE1 of the error amplifier circuit AMP1 receives a switching control signal Sc1 output from the switching circuit 3*b*. A connection point between the resistors R11 and R12 is connected to a noninverting input terminal of the error amplifier circuit AMP1, and the reference voltage Vr1 is input in an inverting input terminal of the error amplifier circuit AMP1. Furthermore, a positive input terminal of the reference voltage generation circuit 11 receives the input voltage Vin, and a negative input terminal of the reference voltage generation circuit 11 is connected to a drain of the NMOS transistor M12*b*.

In the second constant voltage circuit CV2, the output control transistor M21*b* is connected between the input terminal IN and the output terminal OUT. A gate of the output control transistor M21*b* is connected to an output terminal of the error amplifier circuit AMP2. Further, the resistors R21 and R22 and the NMOS transistor M22*b* are connected in series between the output terminal OUT and the ground voltage terminal GND. Each of a gate of the NMOS transistor M22*b* and a chip enable signal input terminal CE2 of the error amplifier circuit AMP2 receives a switching control signal Sc2 output from the switching circuit 3*b*. A connection point between the resistors R21 and R22 is connected to a noninverting input terminal of the error amplifier circuit AMP2, and the reference voltage Vr2 is input in an inverting input terminal of the error amplifier circuit AMP2. Furthermore, a positive input terminal of the reference voltage generation circuit 21 receives the input voltage Vin, and a negative input terminal of the reference voltage generation circuit 21 is connected to a drain of the NMOS transistor M22*b*.

In the constant voltage circuit 1*b* thus configured, the first constant voltage circuit CV1 and the second constant voltage circuit CV2 are driven and controlled by switching control signals Sc1 and Sc2, respectively, which are output from the switching circuit 3*b*. That is, the first constant voltage circuit CV1 is activated when the switching control signal Sc1 is at a high level (HIGH), while the second constant voltage circuit CV2 is activated when the switching control signal Sc2 is at the high level. Further, when the switching control signal Sc1 is at a low level (LOW), the NMOS transistor M12*b* is turned off, so that electric supply to the reference voltage generation circuit 11 and the resistors R11 and R12 is stopped and the operation of the error amplifier circuit AMP1 is stopped. In a similar manner, when the switching control signal Sc2 is at the low level, the NMOS transistor M22*b* is turned off, so that electric supply to the reference voltage generation circuit 21 and the resistors R21 and R22 is stopped and the operation of the error amplifier circuit AMP2 is stopped.

Depending on the type of the load 10, the constant voltage circuit may be in one of three states of an operating state, a standby state, and a power-off state. In the standby state, characteristics required for the constant voltage circuit, such as the responsiveness to the change in each of the input voltage Vin and the output voltage Vout, are not very demanding and the amount of the output current io becomes substantially small, compared with the operating state. Therefore, even if the current drive capacity of the output control transistor is small, a serious problem is not caused. In consideration of this, separately from the first constant voltage circuit CV1 operated exclusively in the operating state, the second constant voltage circuit CV2 is provided for being operated exclusively in the standby state in which an amount of electric power consumption is reduced. Accordingly, switching is made between the two constant voltage circuits by causing the switching circuit 3*b* to output either one of the switching control signals Sc1 and Sc2. As a result, an amount of current consumed in the standby state can be further reduced.

As described above, the rise time of the output voltage Vout is different between a case in which the first constant voltage circuit CV1 is activated upon power-on of the power supply and a case in which the second constant voltage circuit CV2 is activated upon power-on of the power supply. Therefore, either one of the fist constant voltage circuit CV1 and the second constant voltage circuit CV2 is selected to be powered on first so as to obtain a more suitable output voltage rise time in consideration of the state of the load 10 and another power supply circuit powered on simultaneously with the power supply. By so doing, it is possible to prevent a problem caused by imbalance between the output voltage output from the constant voltage circuit and the output voltage output from the another power supply circuit when the power supply is powered on. Further, setting of the switching circuit 3*b* may be changed at any necessary time after the output voltage Vout has risen such that the switching circuit 3*b* switches to either one of the first constant voltage circuit CV1 and the second constant voltage circuit CV2, which is more suitable in consideration of such factors as an amount of the load current and performance requested for the power supply by the load.

The constant voltage circuit 1*b* of the above embodiment, which includes two constant voltage circuits (i.e., the first constant voltage circuit CV1 and the second constant voltage circuit CV2), is one of examples. Therefore, this description is not limited to the above embodiment but applicable also to a constant voltage circuit which includes more than two constant voltage circuits.

As described above, the constant voltage circuit 1*b* of FIG. 5 includes the first constant voltage circuit CV1 having relatively high responsiveness to the change in each of the input voltage Vin and the output voltage Vout and the second constant voltage circuit CV2 having a substantially small amount of self-consumption current. The constant voltage circuit 1*b* is designed such that either one of the first constant voltage circuit CV1 and the second constant voltage circuit CV2 is selected upon power-on of the power supply so as to change the rise time of the output voltage Vout. Accordingly, the rise time of the output voltage Vout can be approximated to the rise time of the power supply in accordance with the conditions required for powering the load.

Figure 6:
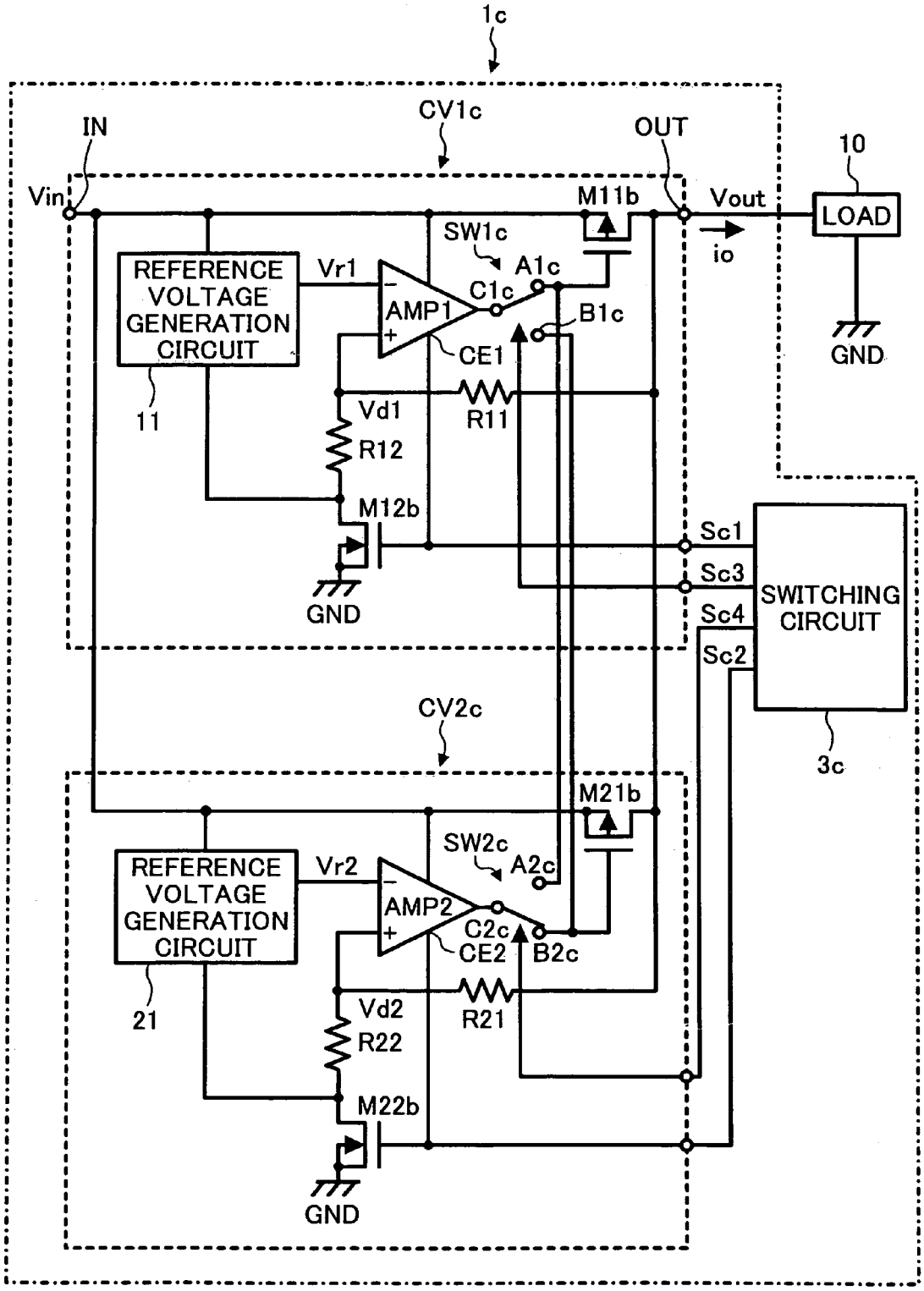
FIG. 6 is a circuit diagram illustrating an exemplary configuration of a constant voltage circuit according to still yet another embodiment.

Further, the constant voltage circuit 1*b* of FIG. 5 may be added with two switches SW1*c* and SW2*c*, as illustrated in FIG. 6, wherein combinations of the error amplifier circuit AMP1 or AMP2 and the output control transistor M11*b* or M21*b* may be arbitrarily changed in accordance with a state of each of switching control signals Sc1 to Sc4 output from the switching circuit 3*c*. A constant voltage circuit 1*c* of FIG. 6 is described below, wherein description is omitted for components of the constant voltage circuit 1*c* which are also components of the constant voltage circuit 1*b* shown in FIG. 5, and differences between the constant voltage circuit 1*b* of FIG. 5 and the constant voltage circuit 1*c* of FIG. 6 are described.

In FIG. 6, the constant voltage circuit 1*c* includes a first constant voltage circuit CV1*c*, a second constant voltage circuit CV2*c*, and the switching circuit 3*c* which exclusively selects and activates either one of the first constant voltage circuit CV1*c* and the second constant voltage circuit CV2*c* according to a setting made in advance. The constant voltage circuit 1*c* is connected to the load 10.

The first constant voltage circuit CV1*c* includes the input terminal IN, the output terminal OUT, the reference voltage generation circuit 11, the error amplifier circuit AMP1, the resistors R11 and R12, the output control transistor M11*b*, the NMOS transistor M12*b*, and a switch SW1*c*.

Similarly, the second constant voltage circuit CV2*c* includes the reference voltage generation circuit 21, the error amplifier circuit AMP2, the resistors R21 and R22, the output control transistor M21*b*, the NMOS transistor M22*b*, and a switch SW2*c*. The switches SW1*c* and SW2*c* and the switching circuit 3*c* form the switching circuit unit.

The constant voltage circuit 1*c* of FIG. 6 is different from the constant voltage circuit 1*b* of FIG. 5 in the following points. First, the first constant voltage circuit CV1*c* of FIG. 6 is provided with the switch SW1*c* for performing connection control of connecting an output terminal of the error amplifier circuit AMP1 to either one of the output control transistors M11*b* and M21*b*. Secondly, the second constant voltage circuit CV2*c* of FIG. 6 is provided with the switch SW2*c* for performing connection control of connecting an output terminal of the error amplifier circuit AMP2 to either one of the output control transistors M11*b* and M21*b*. Thirdly, the switches SW1*c* and SW2*c* are controlled by the corresponding switching control signals Sc3 and Sc4, respectively, which are output from the switching circuit 3*c*.

A common terminal C1*c* of the switch SW1*c* is connected to the output terminal of the error amplifier circuit AMP1. A terminal A1*c* of the switch SW1*c* is connected to a gate of the output control transistor M11*b*. A terminal B1*c* of the switch SW1*c* is connected to a gate of the output control transistor M21*b*. Similarly, a common terminal C2*c* of the switch SW2*c* is connected to the output terminal of the error amplifier circuit AMP2. A terminal A2*c* of the switch SW2*c* is connected to the gate of the output control transistor M11*b*. A terminal B2*c* of the switch SW2*c* is connected to the gate of the output control transistor M21*b*.

The switching circuit 3*c* of FIG. 6 outputs the switching control signal Sc3 to the switch SW1*c* or the switching control signal Sc4 to the switch SW2*c* according to the setting made in advance. In accordance with the switching control signal Sc3 output from the switching circuit 3*c*, the switch SW1*c* connects the output terminal of the error amplifier circuit AMP1 to the gate of either one of the output control transistors M11*b* and M21*b*. Similarly, in accordance with the switching control signal Sc4 output from the switching circuit 3*c*, the switch SW2*c* connects the output terminal of the error amplifier circuit AMP2 to the gate of either one of the output control transistors M11*b* and M21*b*.

In the constant voltage circuit 1*c* of FIG. 6 thus configured, when the load 10 is in the operating state, the switching circuit 3*c* chooses a combination of the error amplifier circuit AMP1 and the output control transistor M11*b* to supply electricity to the load 10. When the load 10 is in the standby state, the switching circuit 3*c* chooses a combination of the error amplifier circuit AMP2 and the output control transistor M21*b* to supply electricity to the load 10. Since the amount of the load current io is substantially small when the load 10 is in the standby state, a device size of the output control transistor M21*b* is made smaller than a device size of the output control transistor M11*b*. Further, the switching circuit 3*c* outputs the switching control signals Sc1 and Sc3 to the first constant voltage circuit CV1*c* and the switching control signals Sc2 and Sc4 to the second constant voltage circuit CV2*c*.

The switching control signal Sc1 is input in a gate of the NMOS transistor M12*b* and a chip enable signal input terminal CE1 of the error amplifier circuit AMP1 to control operation of the NMOS transistor M12*b* and the error amplifier circuit AMP1, so that electric supply to the reference voltage generation circuit 11 and the resistors R11 and R12 is controlled. Similarly, the switching control signal Sc2 is input in a gate of the NMOS transistor M22*b* and a chip enable signal input terminal CE2 of the error amplifier circuit AMP2 to control operation of the NMOS transistor M22*b* and the error amplifier circuit AMP2, so that electric supply to the reference voltage generation circuit 21 and the resistors R21 and R22 is controlled.

The switching control signal Sc3 is input in the switch SW1*c* to cause the switch SW1*c* to connect the common terminal C1*c* with either one of the terminal A1*c* and the terminal B1*c*. Similarly, the switching control signal Sc4 is input in the switch SW2*c* to cause the switch SW2*c* to connect the common terminal C2*c* with either one of the terminal A2*c* and the terminal B2*c*. Accordingly, when the power supply is powered on, the constant voltage circuit 1*c* of FIG. 6 can obtain four different switching combinations and thus four different rise times of the output voltage Vout, and select one of the four different switching combinations which is most suitable.

In other words, the shortest rise time of the output voltage Vout can be obtained by selecting a combination of the error amplifier circuit AMP1 and the output control transistor M11*b*. Meanwhile, the longest rise time of the output voltage Vout can be obtained by selecting a combination of the error amplifier circuit AMP2 and the output control transistor M21*b*. An intermediate time between the shortest time and the longest time can be obtained by selecting a combination of the error amplifier circuit AMP1 and the output control transistor M21*b* or a combination of the error amplifier circuit AMP2 and the output control transistor M11*b*.

Setting of the switching circuit 3*c* may be changed at any necessary time after the output voltage Vout has risen such that the switching circuit 3*c* switches to either one of the first constant voltage circuit CV1*c* and the second constant voltage circuit CV2*c*, which is more suitable in consideration of such factors as the amount of the load current and performance requested for the power supply by the load. Further, the setting of the switching circuit 3*c* may be changed such that the switching circuit 3*c* switches to a suitable combination from the combinations of the error amplifier circuit AMP1 and the output control transistor M11*b*, the error amplifier circuit AMP1 and the output control transistor M21*b*, the error amplifier circuit AMP2 and the output control transistor M11*b*, and the error amplifier circuit AMP2 and the output control transistor M21*b*.

The constant voltage circuit 1*c* of the above embodiment, which includes two constant voltage circuits (i.e., the first constant voltage circuit CV1*c* and the second constant voltage circuit CV2*c*), is one of examples. Therefore, this description is not limited to the above embodiment but applicable also to a constant voltage circuit which includes more than two constant voltage circuits.

As described above, the constant voltage circuit 1*c* of FIG. 6 is capable of arbitrarily selecting a combination from the combinations of the error amplifier circuit AMP1 and the output control transistor M11*b*, the error amplifier circuit AMP1 and the output control transistor M21*b*, the error amplifier circuit AMP2 and the output control transistor M11*b*, and the error amplifier circuit AMP2 and the output control transistor M21*b*. Therefore, the constant voltage circuit 1*c* can obtain the four different connection combinations to be used at the power-on of the power supply. Accordingly, the rise time of the output voltage Vout can be approximated to the rise time of the power supply in accordance with the conditions required for powering the load.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

This patent specification is based on Japanese patent application No. 2004-051636 filed on Feb. 26, 2004 in the Japan Patent Office, the entire contents of which are incorporated by reference herein.

What is claimed is:

1. A constant voltage outputting apparatus comprising:

an input terminal configured to receive an input voltage;

an output terminal configured to output an output voltage;

a control unit configured to detect the output voltage and output a control signal equalizing the detected output voltage with a predetermined constant voltage;

a plurality of output control transistors each configured to receive the control signal and control, according to the control signal, currents flowing from the input terminal to the output terminal; and a switching unit configured to switch the plurality of output control transistors to input the control signal thereto according to a predetermined setting, said switching unit including a plurality of switches corresponding to respective ones of said plurality of output control transistors and enabling the switching unit to select two or more of the plurality of output control transistors to allow use of a combination of the current drive capacities of the two or more selected output control transistors.

2. The constant voltage outputting apparatus as described in claim 1, wherein the switching unit selects said two or more of the plurality of output control transistors based on conditions required for driving a load.

3. The constant voltage outputting apparatus as described in claim 1, wherein the switching unit is preset to select said two or more of the plurality of output control transistors at any necessary time after the output voltage has risen.

4. A constant voltage outputting apparatus comprising:

an input terminal configured to receive an input voltage;

an output terminal configured to output an output voltage;

a plurality of constant voltage circuits of different characteristics each configured to generate a predetermined constant voltage based on the input voltage and output the predetermined constant voltage to the output terminal; and a switching unit configured to switch the plurality of constant voltage circuits to activate one of the plurality of constant voltage circuits selected in advance and inactivate the rest of the plurality of constant voltage circuits.

5. The constant voltage outputting apparatus as described in claim 4, wherein each of the plurality of constant voltage circuits comprises:

an output voltage detection circuit configured to detect the output voltage and output a proportional voltage to the detected output voltage;

a reference voltage generation circuit configured to generate and output a predetermined reference voltage;

an error amplifier circuit configured to output a control signal equalizing the proportional voltage with the predetermined reference voltage; and an output control transistor configured to receive the control signal and control, according to the control signal, currents flowing from the input terminal to the output terminal.

6. The constant voltage outputting apparatus as described in claim 5, wherein, for the rest of the plurality of constant voltage circuits, the switching unit stops operation of the error amplifier circuit and electric supply to the output voltage detection circuit and the reference voltage generation circuit.

7. The constant voltage outputting apparatus as described in claim 4, wherein the switching unit is preset to select one of the plurality of constant voltage circuits at any necessary time after the output voltage has risen.

8. The constant voltage outputting apparatus as described in claim 6, wherein the switching unit allows the control signal output from the error amplifier circuit of the activated one of the plurality of constant voltage circuits to be input in at least one of the output control transistors of the plurality of constant voltage circuits, which is selected in advance.

9. A constant voltage outputting apparatus comprising:

input means for receiving an input voltage;

output means for outputting an output voltage;

control means for detecting the output voltage and outputting a control signal equalizing the detected output voltage with a predetermined constant voltage;

a plurality of output control means for receiving the control signal and controlling, according to the control signal, currents flowing from the input means to the output means; and switching means for switching the plurality of output control means to input the control signal thereto according to a predetermined setting, said switching means including a plurality of switches corresponding to respective ones of said plurality of output control means and enabling the switching means to select two or more of the plurality of output control means to allow use of a combination of the current drive capacities of the two or more selected output control means.

10. The constant voltage outputting apparatus as described in claim 9, wherein the switching means selects said two or more of the plurality of output control means based on conditions required for driving a load.

11. The constant voltage outputting apparatus as described in claim 9, wherein the switching means is preset to select said two or more of the plurality of output control means at any necessary time after the output voltage has risen.

12. A constant voltage outputting apparatus comprising:

input means for receiving an input voltage;

output means for outputting an output voltage;

a plurality of constant voltage outputting means of different characteristics for generating a predetermined constant voltage based on the input voltage and outputting the predetermined constant voltage to the output means; and switching means for switching the plurality of constant voltage outputting means to activate one of the plurality of constant voltage outputting means selected in advance and inactivate the rest of the plurality of constant voltage outputting means.

13. The constant voltage outputting apparatus as described in claim 12, wherein each of the plurality of constant voltage outputting means comprises:

output voltage detection means for detecting the output voltage and outputting a proportional voltage to the detected output voltage;

reference voltage generation means for generating and outputting a predetermined reference voltage;

error amplifier means for outputting a control signal equalizing the proportional voltage with the predetermined reference voltage; and output control means for receiving the control signal and controlling, according to the control signal, currents flowing from the input means to the output means.

14. The constant voltage outputting apparatus as described in claim 13, wherein, for the rest of the plurality of constant voltage outputting means, the switching means stops operation of the error amplifier means and electric supply to the output voltage detection means and the reference voltage generation means.

15. The constant voltage outputting apparatus as described in claim 12, wherein the switching means is preset to select one of the plurality of constant voltage outputting means at any necessary time after the output voltage has risen.

16. The constant voltage outputting apparatus as described in claim 14, wherein the switching means allows the control signal output from the error amplifier means of the activated one of the plurality of constant voltage outputting means to be input in at least one of the output control means of the plurality of constant voltage outputting means, which is selected in advance.

17. A constant voltage outputting method comprising:

providing an input terminal configured to receive an input voltage and an output terminal configured to output an output voltage;

providing a plurality of output control transistors and a switching unit;

detecting the output voltage;

outputting a control signal equalizing the detected output voltage with a predetermined constant voltage; and switching the plurality of output control transistors to select two or more of the plurality of output control transistors and input the control signal thereto according to a predetermined setting to control, according to the control signal, currents flowing from the input terminal to the output terminal based on a combination of the current drive capacities of the two or more selected output control transistors.

18. The constant voltage outputting method as described in claim 17, wherein the switching unit selects said two or more of the plurality of output control transistors based on conditions required for driving a load.

19. The constant voltage outputting method as described in claim 17, wherein the switching unit is preset to select said two or more of the plurality of output control transistors at any necessary time after the output voltage has risen.

20. A constant voltage outputting method comprising:

providing an input terminal configured to receive an input voltage and an output terminal configured to output an output voltage;

providing a plurality of constant voltage circuits of different characteristics and a switching unit;

switching the plurality of constant voltage circuits to generate a predetermined constant voltage based on the input voltage;

activating one of the plurality of constant voltage circuits selected in advance;

inactivating the rest of the plurality of the constant voltage circuits; and outputting the predetermined constant voltage to the output terminal.

21. The constant voltage outputting method as described in claim 20, wherein the outputting step comprises:

detecting the output voltage and outputting a proportional voltage to the detected output voltage;

generating and outputting a predetermined reference voltage;

outputting a control signal equalizing the proportional voltage with the predetermined reference voltage; and controlling, according to the control signal, currents flowing from the input terminal to the output terminal.

22. The constant voltage outputting method as described in claim 21, wherein the inactivating step stops operation of the rest of the plurality of constant voltage circuits.

23. The constant voltage outputting method as described in claim 20, wherein the switching unit is preset to select one of the plurality of constant voltage circuits at any necessary time after the output voltage has risen.

24. The constant voltage outputting method as described in claim 22, wherein the switching step allows the control signal generated by the activated one of the plurality of constant voltage circuits to be input in at least one of the plurality of constant voltage circuits selected in advance.

25. The constant voltage outputting apparatus as described in claim 4, wherein selection of said one of the plurality of constant voltage circuits to be activated is based on one or more of maximum output current, ripple rejection frequency, and transient response of said one of the plurality of constant voltage circuit.

26. The constant voltage outputting apparatus of claim 4, wherein when said switching unit switches the plurality of constant voltage circuits to activate said one of the plurality of constant voltage circuits and deactivate said rest of the plurality of constant voltage circuits, power supplies to said rest of the plurality of constant voltage circuits are stopped.

* * * * *